US005078878A

United States Patent [19]

Charette

[11] Patent Number: 5,078,878

[45] Date of Patent: Jan. 7, 1992

[54] PRESSURE KNOTTER SCREENING APPARATUS

[75] Inventor: Ernest J. Charette, Taunton, Mass.

[73] Assignee: Bird Escher Wyss, Mansfield, Mass.

[21] Appl. No.: 377,798

[22] Filed: Jul. 7, 1989

Related U.S. Application Data

[63] Continuation of Ser. No. 164,787, Mar. 7, 1988, abandoned.

[51] Int. Cl.[5] ..... D21D 5/00

[52] U.S. Cl. ..... 210/408; 210/414; 210/415; 209/273; 209/296; 209/306; 209/379

[58] Field of Search ..... 210/405, 415, 413, 498, 210/407, 408, 414; 209/273, 306, 296, 379, 250, 211; 162/55

[56] References Cited

U.S. PATENT DOCUMENTS

| | | | |
|---|---|---|---|
| 2,553,567 | 5/1951 | Fette | 210/414 X |
| 3,029,951 | 4/1962 | Cannon | 210/414 X |
| 4,356,085 | 10/1982 | Schön et al. | 209/273 |

*Primary Examiner*—David A. Simmons

*Assistant Examiner*—Thi Dang

*Attorney, Agent, or Firm*—Fish & Richardson

[57] ABSTRACT

A rotor is disposed concentrically within a cylindrical screen. The rotor carries a plurality of blades in close proximity to the screen to produce hydrodynamic pulses opposing fluid flow to clear the screen. Each blade includes a first portion affixed to the rotor, this first portion including an inclined face and a substantially raidally extending face. A second portion of the blade is removably affixed to the radially extending face of the first portion. The removable second portion extends radially beyond the first portion. After the removable portion has become worn from extended use, it can be removed and replaced with a new second portion. In a preferred embodiment, the thickness of the second portion of the blade is equal to or greater than the diameter of holes in the screen. It is also preferred that the length of the second blade portion extending beyond the first portion be greater than the diameter of holes in the screen. In this embodiment the length of the projection of the inclined face of the first portion should be greater than the length of the radially extending face.

9 Claims, 2 Drawing Sheets

PRESSURE KNOTTER SCREENING APPARATUS

This is a continuation of co-pending application Ser. No. 164,787 filed on Mar. 7, 1988, now abandoned.

BACKGROUND OF THE INVENTION

This invention relates to the rotor in a pressure knotter.

In the papermaking process, wood knots and foreign material such as stones or pebbles must be separated from the fluidized pulp. This separation is generally accomplished by passing the fluid pulp through a cylindrical screen whose apertures are sized to reject unwanted solids. During this separation operation, the oversized solids such as knots and pebbles plug the screen apertures. It is known in the prior art to produce periodic hydrodynamic pulses in the direction opposite to the flow of the fluidized pulp through the screen so as to clear the screen A typical prior art configuration is shown in FIG. 1. In this configuration, hydrofoils 10 carried on a rotor 12 sweep past a screen 14 to clear the screen 14. The hydrofoils 10 are subject to wear at the portion of the hydrofoil near the screen resulting in part from the action of small solid particles which pass through the screen Because in many commercially available screens the hydrofoils 10 and rotor 12 form a unitary structure, upon wear, the whole rotor/hydrofoil assembly has to be replaced. In other commercially available screening apparatus, the hydrofoil alone is replaced even though only a portion of the hydrofoil experiences wear. Other rotor-blade configurations are shown in U.S. Pat. Nos. 4,200,537; 3,363,759 and 3,680,696 and Canadian Patent No. 1,136,092.

SUMMARY OF THE INVENTION

According to the invention, the screening apparatus includes a cylindrical screen and a rotor disposed concentrically within the screen. The rotor carries a plurality of blades for motion in close proximity to the screen. The rotor blades are disposed on the surface of the rotor such that circumferential bands or rows of blades overlap one another. This arrangement insures that the entire area of the screen basket is covered by a rotor blade so that the entire basket will be kept free from plugging. Each blade includes a first portion affixed to the rotor, the first portion including an inclined face and a substantially radially extending face. A second blade portion is removably affixed to the radially extending face of the first portion and a part of the second portion extends radially beyond the first blade portion.

In a preferred embodiment, the thickness of the second blade portion is equal to or greater than the diameter of holes in the screen. Further, the length of the second portion extending beyond the first portion is greater than the diameter of holes in the screen. It is also preferred that the length of the projection of the inclined face be greater than the length of the radially extending face of the first portion. It is also preferred that fluid flowing between the rotor and the screen has an axial velocity greater than or equal to four feet per second. The annulus between screen and rotor is sized to maintain this relationship.

The second blade portion which extends to the proximity of the screen is subjected to the most wear. Since it is removably affixed to the first blade portion, it can be removed and replaced without the necessity of replacing the whole rotor assembly or whole hydrofoil as known in the prior art. This invention thus results in lower operating costs of the screening apparatus. That the thickness of the second portion of the blade is equal to or greater than the diameter of holes in the screen assures effective hydrodynamic pulses for keeping the apertures unclogged. Because the length of the second blade portion which extends beyond the first blade portion is greater than the diameter of the holes, there is a reduced likelihood of jamming as a result of solid matter passing through the screen.

DESCRIPTION OF THE PREFERRED EMBODIMENT

Figure 1:
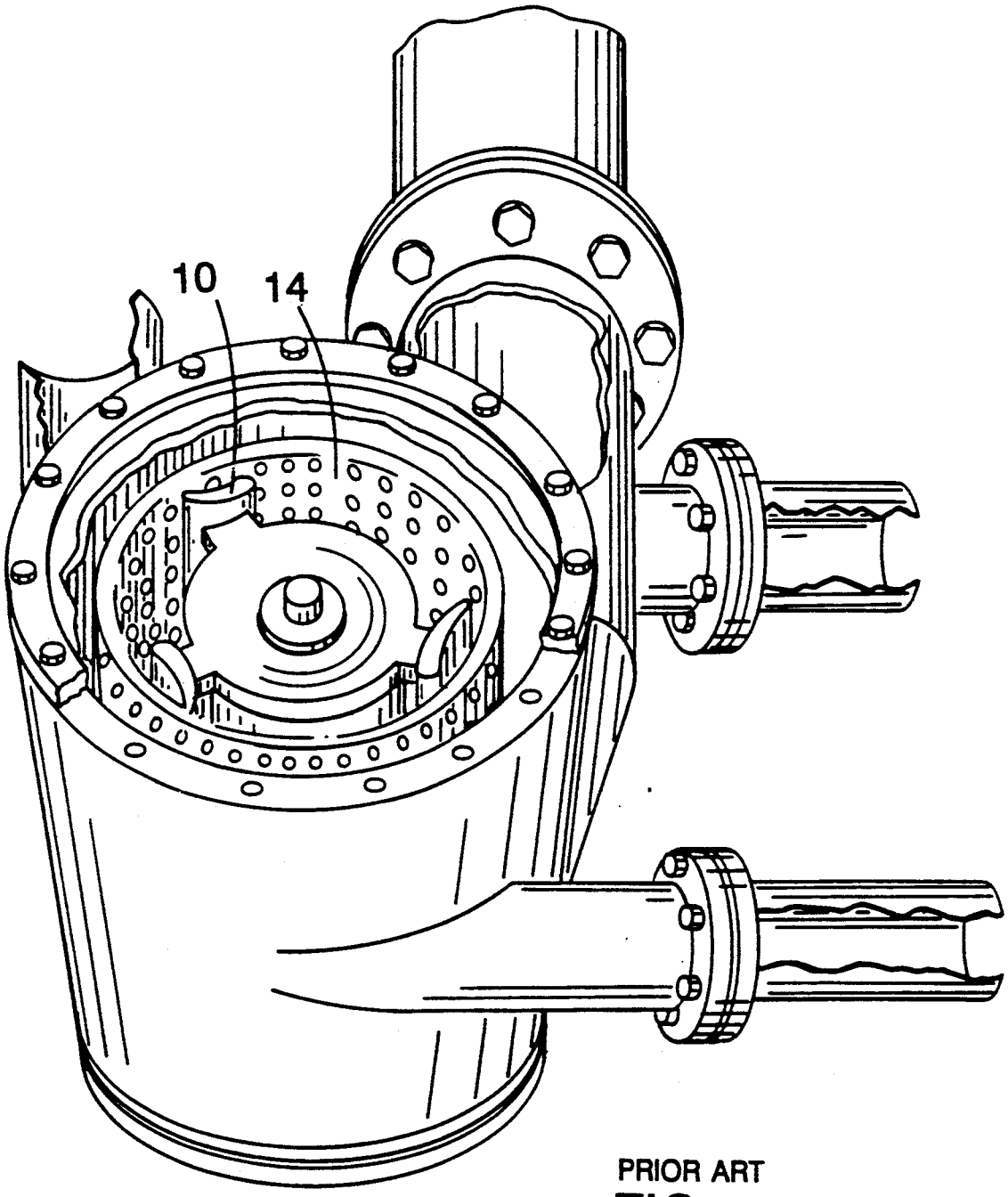
PRIOR ART FIG. 1
FIG. 1 is a perspective view of a prior art pressure knotter.
Figure 2:
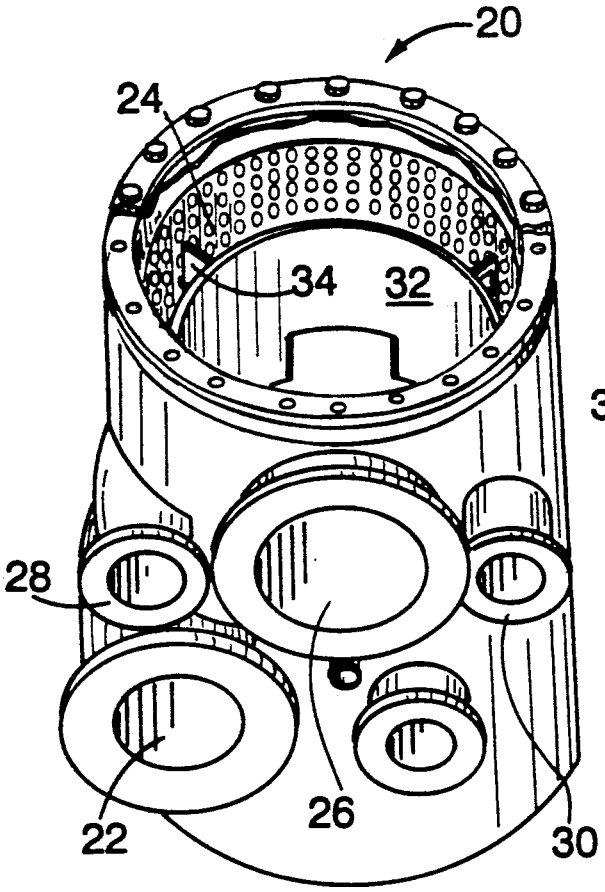
FIG. 2 is a perspective view of the pressure knotter screening apparatus of the present invention.

Pressure knotter apparatus 20 shown in FIG. 2 includes an inlet 22 for receiving fluid pulp having a pulp concentration in the range 2–6%. The fluid pulp travels upwardly and passes inwardly through a screen 24. Fluid pulp which passes through the screen 24 exits through an accepts exit 26. Dilution water enters the apparatus 20 through an inlet 28. Knots, pebbles and other solid material too large to pass through the holes in the screen 24 exit through a rejects exit 30.

Figure 3:
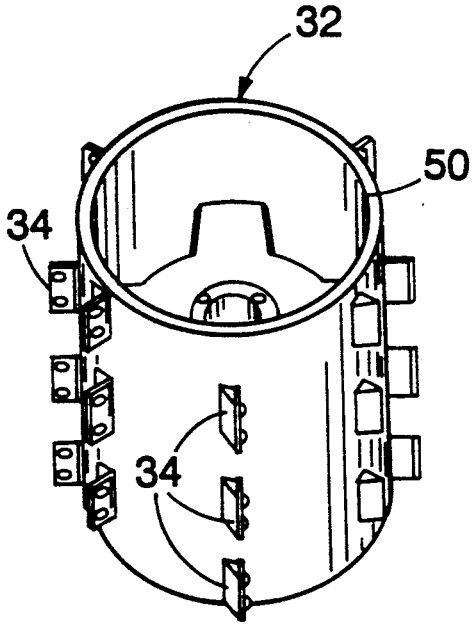
FIG. 3 is a perspective view of the rotor of the screening apparatus.
Figure 4:
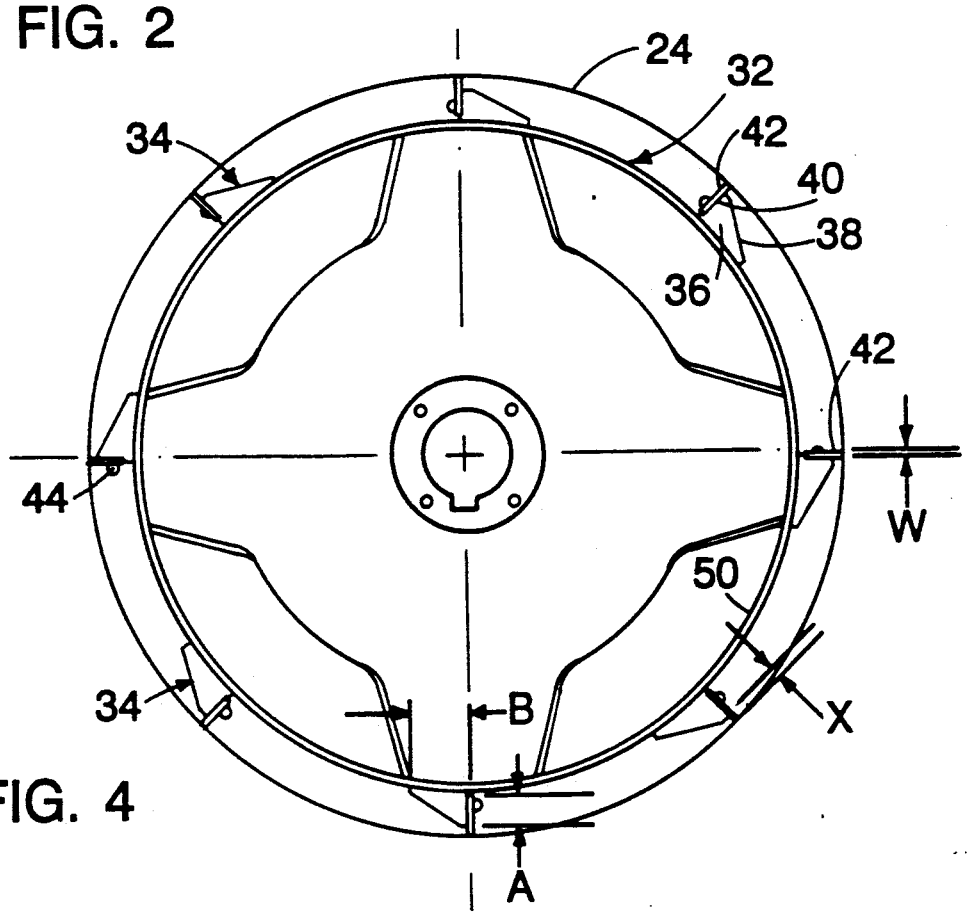
FIG. 4 is a cross-sectional view of the rotor of FIG. 3.

With reference now to FIGS. 2, 3, and 4, a rotor assembly 32 is disposed concentrically with respect to the screen 24. The rotor assembly 32 generates outwardly directed hydrodynamic forces tending to unclog the screen 24. In particular, the rotor assembly 32 includes a plurality of blades 34 which sweep across the screen 24 in close proximity to it to generate hydrodynamic flow radially outwardly. As shown in FIG. 3, the blades 34 are disposed on the rotor assembly 32 in a staggered fashion so that circumferential bands or rows of blades overlap one another. This arrangement insures that the entire surface area of the screen 24 is swept by the blades 34. The blades 34 include a first portion 36 having an inclined face 38 and a substantially radially extending face 40. A second portion 42 of the blade 34 is removably affixed to the radially extending face 40 of the first portion 36. The second portion 42 may be affixed to the first portion 36 by machine screws 44. As will be appreciated by those skilled in the art, the second portion 42 will receive the most wear because of its motion in close proximity to the screen 24. Because the second portion 42 is removable, it can be replaced as needed after a period of use.

It is preferred that the thickness W of the second portion 42 be greater than or equal to the diameter of the holes in the screen 24. By keeping the thickness W of the pulsemaking second portion 42 greater than the hole diameter assures that the maximum positive pulse is developed for unclogging the screen 24. If the blade were narrower than the hole diameter, there will be a negative pulse developed on the trailing side of the blade as the blade passes across the hole diameter. It is also preferred that the length X of the second portion 42 of the blade 34 which extends beyond the first portion 36 be greater than the diameter of holes in the screen 24. In this case, there is less likelihood that solid particles passing through the screen 24 will become lodged between the blade 34 and the screen 24. It is furthermore preferred that the length B be greater than or equal to the dimension A shown in FIG. 4. This relationship restricts the steepness of the angle of the inclined face 38. If the length B were less than the dimension A, the resultant angle would be quite steep. A steep angle would have a higher drag coefficient and would in turn require more power for rotation of the rotor assembly 32. By keeping the angle less steep, the fluid undergoes a more gradual acceleration which in turn requires lower horsepower for operation. It is also preferred that the fluid pulp travelling upwardly in the space between the screen 24 and the drum 50 of the rotor assembly 32 be greater than or equal to four feet per second. Maintaining this velocity will minimize the buildup of pulp process in the area between the blades and screen. Such a buildup would increase the power required to rotate the rotor Furthermore, keeping the velocities up will encourage the process to move axially toward the accepts exit 26 and will minimize the chance of the process settling out As shown in FIG. 3, the blades 34 are substantially aligned with an axis of rotation of the rotor assembly 32. The blades 34, however, may be disposed on the drum 50 making an angle with the axis of rotation, if desired.

The rotor assembly of the present invention is highly effective in unclogging the screen 24. Because the second portion 42 of the blade 34 is removable, substantial reductions in operating costs are achievable since the whole rotor assembly 32 need not be replaced.

It is recognized that modifications and variations of the present invention will occur to those skilled in the art and it is intended that all such modifications and variations be included within the scope of the appended claims.

What is claimed is:

1. A screening apparatus for removing wood knots and other foreign material from a pressurized stream of fluidized pulp, said apparatus comprising:

a cylindrical screen for receiving the pressurized stream of fluidized pulp, the screen having openings sized to reject foreign material travelling in the pressurized stream, and there being a pressure differential across the screen;

a drum disposed concentrically with respect to the screen to define an annular space, the drum carrying on one surface one or more blades projecting into said annular space in close proximity to the screen, for clearing the openings of foreign material, each blade having a first portion and a second portion, the first portion having an inclined leading surface which faces toward the screen, said inclined surface having an upstream end and a downstream end, the upstream end being the leading end in the direction of motion of the blade and the downstream end being the lagging end in the direction of motion of the blade, the inclined leading surface being configured so that at its downstream end it is closer to the screen than at its upstream end, with the result that the downstream end of the inclined leading surface is the end closest to the screen and fluidized pulp will be forced from the drum to the screen during operation of the screening apparatus, said first portion also having a downstream-facing surface at the downstream end of said first portion, said downstream-facing surface beginning at the downstream end of said inclined surface and extending in a direction away from said screen, the inclined leading surface having a substantial axial length at both its upstream and downstream ends, the second portion having a leading surface positioned so as to be removably affixed to the downstream-facing surface of the first portion at the downstream end of the first portion, said leading surface extending toward the screen beyond the downstream end of the inclined leading surface so as to expose a portion of the leading surface of the second portion to the flow of fluidized pulp as it reaches the downstream end of said inclined surface, the second portion of the blade being positioned so that it is subjected to the most wear of any portion of the blade, and so that it can be replaced when worn.

2. The apparatus of claim 1 wherein the drum and blades are on the accepts side of the screen and wherein the second portion of the blade has a circumferentially extending surface at its end closest the screen, the circumferentially extending surface being positioned in such close proximity to the openings in the screen and being of such circumferential width (W) by comparison to the openings in the screen that openings in the screen are substantially sealed momentarily as the blade passes over the openings.

3. The apparatus of claim 2 wherein the leading surface of the second portion extends beyond the downstream end of the inclined surface by a length (X) greater than the diameter of the openings in the screen.

4. The apparatus of claim 1 wherein the removable, second portion of the blade has a generally rectangular cross section.

5. The apparatus of claim 1 wherein the angle of inclination of the inclined surface (R) is so that the circumferential length of the inclined surface (B) is greater than the radial length (A) of the inclined surface.

6. The apparatus of claim 1 wherein said annulus is sized to provide an axial fluid velocity greater than or equal to four feet per second.

7. The apparatus of claim 1 wherein the second, removable portion is made of a more wear-resistant material than the first portion.

8. The apparatus of claim 1 wherein the first portion has end surfaces at each axial end, each end surface extending substantially along the direction of motion of the blades, with the result that fluid is forced to travel over the blades and thus is forced from the drum to the screen.

9. The apparatus of claim 1 wherein the drum and blades are on the accepts side of the screen, the screen is radially outside of the drum and the blades extend from the drum radially outwardly toward the screen, the first portion of the blade has end surfaces at each axial end, each end surface extending substantially along the direction of motion of the blades, with the result that fluid is forced to travel over the blades and thus is forced toward the drum, the second portion of the blade has a circumferentially extending surface at its radially-outermost end, the circumferentially extending surface being positioned in such close proximity to the openings in the screen and being of such circumferential width (W) by comparison to the openings in the screen that openings in the screen are substantially sealed momentarily as the blade passes over the openings, the second, removable portion is made of a more wear-resistant material than the first portion, the radially extending leading face of the second portion has a radial length (X) greater than the diameter of the openings in the screen, the first portion of the blade has a substantially radially extending trailing edge to which the second portion of the blade is affixed, the removable, second portion of the blade has a generally rectangular cross section, the angle of inclination of the inclined surface (R) is so that the circumferential length of the inclined surface (B) is greater than the radial length (A) of the inclined surface, and the drum and screen form an annulus sized to provide an axial fluid velocity greater than or equal to four feet per second.

* * * * *